US006808473B2

(12) United States Patent
Hisano et al.

(10) Patent No.: US 6,808,473 B2
(45) Date of Patent: Oct. 26, 2004

(54) EXERCISE PROMOTION DEVICE, AND EXERCISE PROMOTION METHOD EMPLOYING THE SAME

(75) Inventors: Atsushi Hisano, Arlington Heights, IL (US); Masahiro Ando, Buffalo Grove, IL (US); Merice A. Washer, Buffalo Grove, IL (US)

(73) Assignee: Omron Corporation, Kyoto (JP)

( * ) Notice: Subject to any disclaimer, the term of this patent is extended or adjusted under 35 U.S.C. 154(b) by 226 days.

(21) Appl. No.: 09/837,304

(22) Filed: Apr. 19, 2001

(65) Prior Publication Data

US 2002/0091049 A1 Jul. 11, 2002

(51) Int. Cl.[7] ..... A63B 21/00

(52) U.S. Cl. ..... 482/8; 482/9; 482/900; 600/300

(58) Field of Search ..... 482/1–9, 900–902; 600/300, 481, 500–502

(56) References Cited

U.S. PATENT DOCUMENTS 4,244,021 A * 1/1981 Chiles ..... 482/4
4,911,427 A * 3/1990 Matsumoto et al. ..... 482/9
5,314,389 A * 5/1994 Dotan ..... 482/3
5,976,083 A * 11/1999 Richardson et al. ..... 600/481
5,989,157 A * 11/1999 Walton ..... 482/4
6,135,951 A * 10/2000 Richardson et al. ..... 600/300

* cited by examiner

*Primary Examiner*—Glenn E. Richman
(74) *Attorney, Agent, or Firm*—Dickstein Shapiro Morin & Oshinsky LLP

(57) ABSTRACT

The objective of this invention is to provide an exercise aid device which can be used for various kinds of exercise and which enables the user to perform aerobic exercise safely and comfortably at the level best suited to that person, and a method which employs this device. In order to achieve this object, the level of intensity of aerobic exercise which is most suitable for the person is considered to be 80% of the AT (Anaerobic Threshold) value as determined by analyzing the pulse rate while that person is exercising. The pulse wave is detected by this headphone-type exercise aid device. The pulse rate is measured at the superficial temporal artery, which is near the right ear. The pulse wave is detected by a sensor of either an optical sensor or an ultrasonic blood velocity meter. Once the optimal exercise is calculated, it is transmitted to the exerciser as the corresponding rhythm through the fitness headphone for maintaining the optimal exercise.

23 Claims, 15 Drawing Sheets

| TUNE NUMBER | SOUND DATA OF THE TUNE | INTENSITY | DURATION (SECOND) | EXERCISE |
|---|---|---|---|---|
| 1 | RELAX | 1 | 47.5 | START |
| 2 | PURE • TO THE PRAIRIE/TO THE FOREST//TO THE RIVER | 1 | 44.5 | COOLING DOWN AFTER EXERCISE |
| 3 | LOVE FOR LOVE • ROBIN S. | 6 | 30 | JUMP ROPE |
| 4 | MIDAS TOUCH - MIDNIGHT STAR | 4 | 30 | BOXING |
| 5 | PUMP UP THE JAM - TECHNOTRONIC | 3 | 30 | KICK BOXING |
| 6 | GET UP! (BEFORE THE NIGHT IS OVER) - TECHNOTRONIC FEATURING YA KID K | 3 | 30 | RUNNING, LIGHT EXERCISE |
| 7 | YOU DON'T HAVE TO WORRY - RYTHMCENTRIC | 5 | 30 | KICK BOXING |
| 8 | YOU DON'T HAVE TO WORRY - RYTHMCENTRIC | 2 | 30 | STRETCHING |
| 9 | YOU DON'T HAVE TO WORRY - RYTHMCENTRIC | 3 | 30 | RUNNING, INTENSIVE STRETCHING |
| 10 | I WILL SURVIVE - GLORIA GAYNOR | 4 | 30 | RUNNING |

FIG. 2

| PURPOSE: CALCULATING AT VALUE | | | |
|---|---|---|---|
| NAME: NO.2 PROGRAM FOR CALCULATING AT VALUE | | | |
| TUNE NUMBER | REPEAT TIME | EXERCISE GUIDANCE DATA | INTENSITY |
| 1 | 2 | IT'S TIME TO START YOUR WORKOUT | 1 |
| 8 | 1 | BEGIN BY STRETCHING YOUR LEGS | 2 |
| 8 | 1 | ROTATE YOUR ARMS | 2 |
| 9 | 2 | BEND FORWARD | 3 |
| 9 | 2 | BEND BACKWARD | 3 |
| 9 | 2 | JOG SLOWLY | 4 |
| 10 | 2 | NOW PICK UP YOUR PACE A LITTLE | 4 |
| 7 | 2 | NOW DO SOME KICKBOXING KICKS | 5 |
| 3 | 4 | NOW JUMP ROPE | 6 |

FIG. 3

EXERCISE PROMOTION DEVICE, AND EXERCISE PROMOTION METHOD EMPLOYING THE SAME

FIELD OF THE INVENTION

This invention concerns an exercise aid device which allows each individual to perform, safely and comfortably, an appropriate level of aerobic exercise without requiring the use of any special equipment, as well as an exercise aid method employing the same.

BACKGROUND OF THE INVENTION

The following types of the prior art already exist today in the field of exercise aid devices used for aerobic exercise.

(a) There are now devices (for example, Omron's HR series heart rate monitors) that use a wristwatch-type monitor to inform the wearer (via a beep or an LCD display) when his heart rate as measured by a heartbeat sensor in a chest belt is in his target zone, which is calculated based on his age.

(b) There are also devices which detect the wearer's heart rate through a chest belt and feed it back to him via headphones connected to the chest belt (Brand name: Heartalker).

(c) Other devices (for example, Polar's M series) measure the resting heart rate, calculate the appropriate range (which they call OwnZone®) based on the heart rate and the person's age, and emit a beep or some other signal to allow the user to maintain his heart rate in this zone.

(d) There are also wristwatch-type exercise aid devices which detect the pulse wave from the pulse of the user's finger while he is gradually increasing the intensity of his exercise, analyze this pulse wave, calculate the AT (Anaerobic Threshold) value, and use this value to inform the user as to the intensity which is appropriate for him. (Japanese Patent Publication 9-75491)

(e) Another technique to determine the AT value has the person pedal a stationary bicycle while the load on the pedals is varied so that the level of intensity gradually increases. During this time the person's heart rate signal or pulse wave signal is detected, and a graph is generated with the heart rate plotted on the horizontal axis and the entropy indicating the fluctuation of the cardiac cycle on the vertical axis. The heart rate corresponding to the lowest point on the graph is then considered to be the AT value. (International Publication: WO99/43392)

(f) Some devices use a photodetector in the person's external auditory canal to monitor the superficial temporal artery and thereby detect the pulse wave. (Japanese Patent Publication: 7-241279)

(g) Another devices use an optical sensor provided on the person's front side of finger to detect the pulse wave. In order to detect pulse wave accurately, the output of the optical sensor is subtracted by an output of a motion sensor attached to the person. (Japanese Patent Publication 11-56827)

Three of the aforesaid prior art techniques, (a), (b) and (c), are exercise monitors which use a chest belt. Such monitors are inconvenient in that they require the user to remove some of his clothing each time he wishes to put on the chest belt which contains the heart rate monitor. Also, it is difficult for the person exercising to notice the beep or the display content the wristwatch-type monitor puts out when it receives and processes the signal from the heartbeat sensor in the chest belt.

Wristwatch-type exercise aid devices which detect the pulse wave in the pulse of the person's finger have two shortcomings. The accuracy with which they detect the pulse wave is inadequate, and it is difficult to communicate the appropriate level of exercise to the person while he is exercising.

Using an indoor stationary bicycle that can determine the AT value limits the exercise to pedaling a bicycle. This is inconvenient, as it does not allow the person to exercise freely out of doors.

And no matter whether the person uses an exercise monitor with a chest belt, a wristwatch-type exercise aid device or an indoor exercise bike, he is liable to find his exercise routine extremely boring. If the user does not inherently want to exercise, because he does not feel comfortable, and he does not feel inclined to exercise rigorously for fitness, he is unlikely to use the device or system for very long.

As is noted on the website of the world-renowned think tank the World Watch Institute, whose address is printed below, obesity and illness caused by insufficient exercise have become a societal problem leading to increased medical costs and lower productivity. While it is true that obesity is caused by insufficient exercise, it could also be said that the spread of television and suburbs designed for automobiles have contributed to the lack of exercise. The details are disclosed in the following site. http://www.worldwatch.org/chairman/issue/001219.html We need to find ways to address, however slightly, the societal problem of insufficient exercise. As the word "couch potato" used in the U.S. and Canada suggests, there are a great many people whose lifestyle entails lounging on the couch and eating potato chips while watching rented videos or spending all their time indoors surfing the internet. Obesity is increasing at a high rate among both children and adults. It is a contributing cause of both heart disease and cancer. Because couch potatoes don't feel like exercising on their own, exercise aid devices must provide enough appeal to get them to want to work out.

For people who do not exercise as a routine part of their daily lives, exercise is not enjoyable. Since they do not enjoy it, they do not continue doing it very long. Music has been used for a long time to motivate and energize people while they are exercising. Many people (more than 40% in our study) wear headphones and listen to music while exercising. After observing at one fitness center seven times in a two-week period, we obtained the following data.

| Males Exercising | Males Exercising while wearing headphones | Females Exercising | Females Exercising While Wearing headphones | People Exercising | People Exercising While Wearing Headphones |
|---|---|---|---|---|---|
| 82 | 30 (approx. 37%) | 83 | 42 (approx. 51%) | 165 | 72 (approx. 43%) |

However, not all exercise is good. Too much exercise can be unhealthy. Please refer the following site. http://www.medical-tribune.co.jp/mtbackno3/3317/17hp/M3317421.htm Appropriate intensity and duration of exercise vary with age, physical strength and level of fitness. No one should exercise if he is sick and is running a temperature. If an elderly person exercises in the same way as a younger person, he may injure his heart, joints or muscles. Furthermore, there are two types of exercise, aerobic and anaerobic. Generally, aerobic exercise is more effective at increasing endurance and reducing body fat, and anaerobic exercise is more effective at increasing muscle strength. The mechanisms which the body uses to generate energy during aerobic and anaerobic exercise are completely different. Immediately after exercise begins, a cycle is put in operation whereby creatine phosphate is broken down to generate energy; however, this cycle lasts only about 40 seconds. Next, the glycolysis cycle goes into effect to generate ATP from glucose and release energy. The glycolysis cycle does not require oxygen, but it generates lactic acid as a product of fatigue. In humans, the accumulation of lactic acid for approximately five minutes will cause the glycolysis cycle to end. What we have described so far is anaerobic exercise. After this point, the TCA cycle uses oxygen to generate ATP from glucose, which makes the exercise aerobic. When the exercise becomes aerobic, glycogen in the muscles is the first energy source tapped. Next, the blood glucose is used. Glycogen from the liver is also used, and subsequently, fat from the fat cells is used. About ten minutes after the start of the exercise, 90% of the reaction process by which aerobic exercise consumes fat has been completed. However, when a person increases the intensity of his exercise too much, his supply of oxygen can become insufficient, which will cause his body to revert to its anaerobic energy scheme, which does not burn body fat. The appropriate range of intensity is one which requires an oxygen intake between 60 and 80% of the maximum intake, depending on the person's age. The intensity of exercise can also be expressed as pulse rate, with exercise resulting in a rate between 50 and 70% of the maximum considered appropriate. This means that an appropriate level of exercise is one that produces a pulse rate between 50 and 70% of the maximum without exceeding the AT value. A level at 90% of the AT value corresponds to a pulse rate equal to 70% of the maximum rate. Results concerning this equation are given in detail on the following websites. The details are disclosed in the following sites. http://www.geocities.co.jp/Colosseum-Athene/2916/kenshu/training.html http://www02.u-page.so-net.ne.jp/yb3/ki-net/undou.html http://www2.ocn.ne.jp/~ikedama/kiso/at.htm Thus a level of exercise at 80% of the AT value would translate to a pulse rate equal to 60% of the maximum rate. This would be the midrange of exercise intensity which is both effective and safe.

PROBLEMS WHICH THIS INVENTION ATTEMPTS TO SOLVE

As the reader may understand from the previous discussion, the type of exercise most effective at burning body fat and eliminating obesity or strengthening the circulatory and respiratory systems and building endurance is aerobic exercise. Aerobic exercise offers a partial solution to the obesity which is proliferating in contemporary society. An exercise aid device is needed which can calculate a target value for each individual's appropriate intensity of exercise within the aerobic range. This device must also be able to determine both before and during exercise whether the person's physical condition allows him to exercise. If his condition is such that he should not be exercising, the device must inform him that he should not begin or that he should stop. If his condition allows him to exercise, it must help him to exercise at an intensity level which is safe and appropriate for him. An exercise aid device is needed which will allow anyone, whether he is a couch potato or an avid fitness buff who belongs to a health club, to exercise comfortably and happily and to choose the exercise best suited to his strength and level of fitness. This device should be portable and it should be useable for various kinds of exercise.

SUMMARY OF THE INVENTION

The objective of this invention is to provide an exercise aid device which can be used for various kinds of exercise and which enables the user to perform aerobic exercise safely and comfortably at the level best suited to that person, and a system which employs this device.

Means Employed to Solve These Problems

To solve the problems detailed above, the following technical concepts are employed.

1) The level of intensity of aerobic exercise which is most suitable for the person is considered to be 80% of the AT value as determined by analyzing the pulse wave while that person is exercising. The pulse wave is detected by the sensor explained later, and the different type of physiological data is obtained depending on the sensor type, such as pulse wave form, blood velocity form. AT value is obtained by analyzing the forms and the characteristics obtained from these forms. The exercise duration is set between 20–40 minutes according to the general understanding.
2) The user's physiological data are monitored before and during his workout to determine if it is safe for him to begin and to check intermittently whether he needs to rest. The monitor measures the user's pulse wave signal, his AT value and his pulse rate, and it uses these values to check his condition before and during his workout.
3) Even people who are less than enthusiastic about exercising, like so-called couch potatoes, will find that they are able to exercise regularly or even daily. Headphones allow sound to be transmitted to the user during the workout to supply him with music, games or instructions, so that his exercise routine will be transformed from a boring obligation to an interesting and enjoyable activity. In addition, this exercise aid device is easier to put on. Instead of being attached to the user's chest, earlobe or finger as in the prior art, the sensor which detects the pulse wave is placed either in the middle of the user's ear or behind his earlobe. This location was chosen so that when the user puts on his headphones or earphones, he is also putting on his pulse wave sensor.
4) The pulse rate is measured at the superficial temporal artery, which is near the right ear. The details are disclosed in the following site. http://www.t2star.com/angio/Neuro2.htm The pulse wave is detected by the following two methods.

(1) Using a Photodetector

The photodetector is placed in external auditory canal of the right ear, and a beam of light is emitted into this artery. Since the proportion of this light which is reflected will vary with the pulse rate, the signal obtained by detecting this reflected light can be considered to represent the pulse rate. In comparison to measuring the pulse rate in the earlobe, measuring it from the superficial temporal artery has a number of benefits. The signal which is obtained is highly accurate and is unlikely to be affected by reflection of nerves, deep breathing or exercise. This method also has the merit that it allows the pulse wave to be measured using a sensor which is built into a set of headphones. However, unless the blood vessel is artificially pressurized, the thickness of the vessel and the density of the blood cells will not vary much with the heart rate, so the AC component of the detected signal (which corresponds to the pulse wave) will be small relative to the DC component.

(2) Using Ultrasound to Measure the Blood Flow

Another method which can be used to measure the pulse in the superficial temporal artery uses ultrasound to measure the blood flow. An ultrasonic wave is transmitted into the artery and the reflected wave is detected. The Doppler effect can then be used to observe the wave form indicating the velocity of the blood flow in the artery. The wave form of the blood flow velocity has a smaller DC component than the signal obtained in method 1 above, so the pulse wave can be detected with greater accuracy.

BRIEF DESCRIPTION OF THE DRAWINGS

FIG. 2 illustrates a sample of music data table provided in the fitness controller.

FIG. 3 illustrates a sample of a fitness music program used to calculate AT value.

DETAILED DESCRIPTION OF THE INVENTION

First Preferred Embodiment

Figure 1:
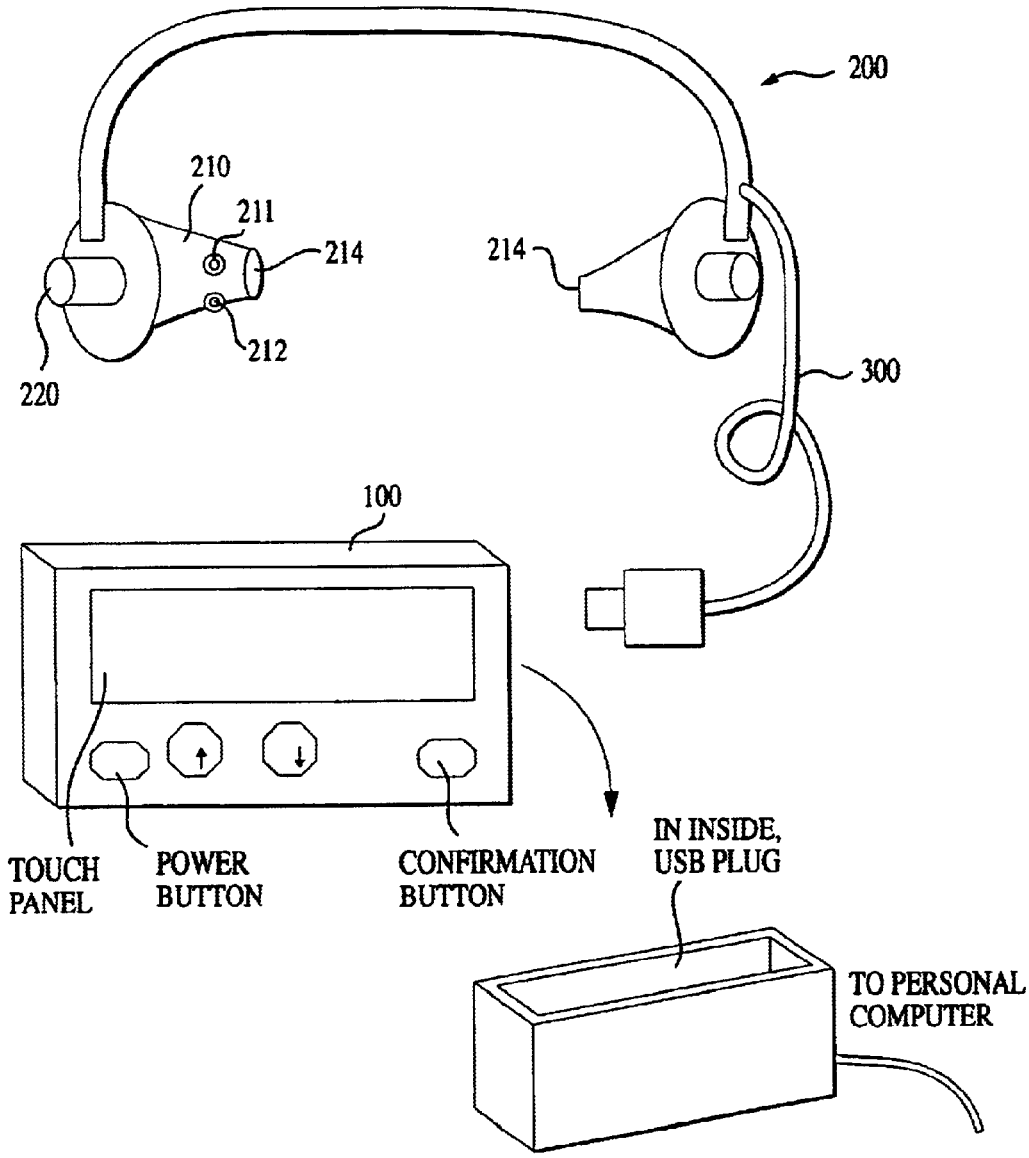
FIG. 1 illustrates the overview of the exercise aid device according to the first preferred embodiment of this invention.

We shall next explain the first preferred embodiment of this invention with reference to the appended drawings. We shall begin by discussing the configuration of the system in the first embodiment, pictured in FIG. 1. This system comprises a fitness controller 100 and fitness headphones 200 which are connected to each other by a cable 100. Although it is not mentioned above, the fitness controller may also be connected to a personal computer.

An acceleration sensor is built into the fitness controller 100 so that it can keep track of the number of steps the user takes or detect actions such as jumping. Using the output data from the acceleration sensor as the basis, the device removes the disturbance generated by the exercise from the wave form signal for the pulse wave recorded during the exercise to obtain a pulse wave signal which corresponds to the heart rate. (See document 1.) The fitness controller stores data to instruct the user to perform exercise at various levels of intensity.

The fitness headphones 200 have an external auditory canal portion connected to an ear piece of music headphones, and a rotary adjustment knob on that portion. The fitness headphones are connected by a cable to the fitness controller. The physiological data (here, the pulse wave signal) of the person who is wearing the headphones is sent from the headphones to the fitness controller. Audio signals and control signals for expanding external auditory canal portion are sent from the fitness controller to the headphones. The fitness headphones connected to the fitness controller allow the wearer to listen to music or workout instructions while his pulse wave is monitored.

The external auditory canal portion 210 of the fitness headphones has a light emitter 211 and a photodetector 212. By turning the rotary knob provided on the external auditory canal portion, the user can adjust how deep the external auditory canal portion extends into his ear and its angle of rotation. The user adjusts the depth and angle of rotation so that the beam emitted by LED in the external auditory canal portion can accurately strike the superficial temporal artery and the reflected light can be detected by the photodetector. The light which strikes the superficial temporal artery will be absorbed and reflected by the blood components flowing through the artery. The reflected light will be affected by the expansion and contraction of the artery according to the heart rate. The reflected light is detected by the photodetector in the external auditory canal portion, and the signal associated with this light can be processed as a pulse wave signal. It is conceivable that when the person wearing the fitness headphones exercises, the resulting vibration will cause the spatial relation between the external auditory canal portion and the external auditory canal to vary so that the S/N of the pulse wave signal representing the light reflected from the superficial temporal artery will decrease. To prevent this, the user must be sure to fix the external auditory canal portion securely in his ear. There is a small opening for audio output in the middle of the external auditory canal portion's axis. Audio signals transmitted from the fitness controller are converted to voice by an integral speaker and output to the user. We shall discuss these matters in detail in a later section; however, when the fitness headphones 200 and fitness controller 100 are connected by a cable 300, the steps disclosed in 1) must be taken to position in the external auditory canal properly.

Figure 8A:
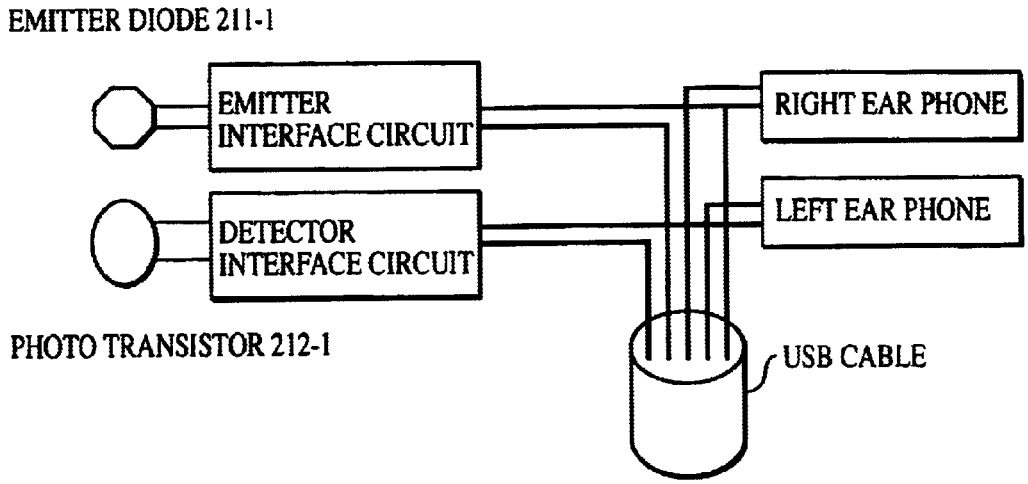
FIG. 8 illustrates the hardware configuration of the first preferred embodiment.
Figure 8B:
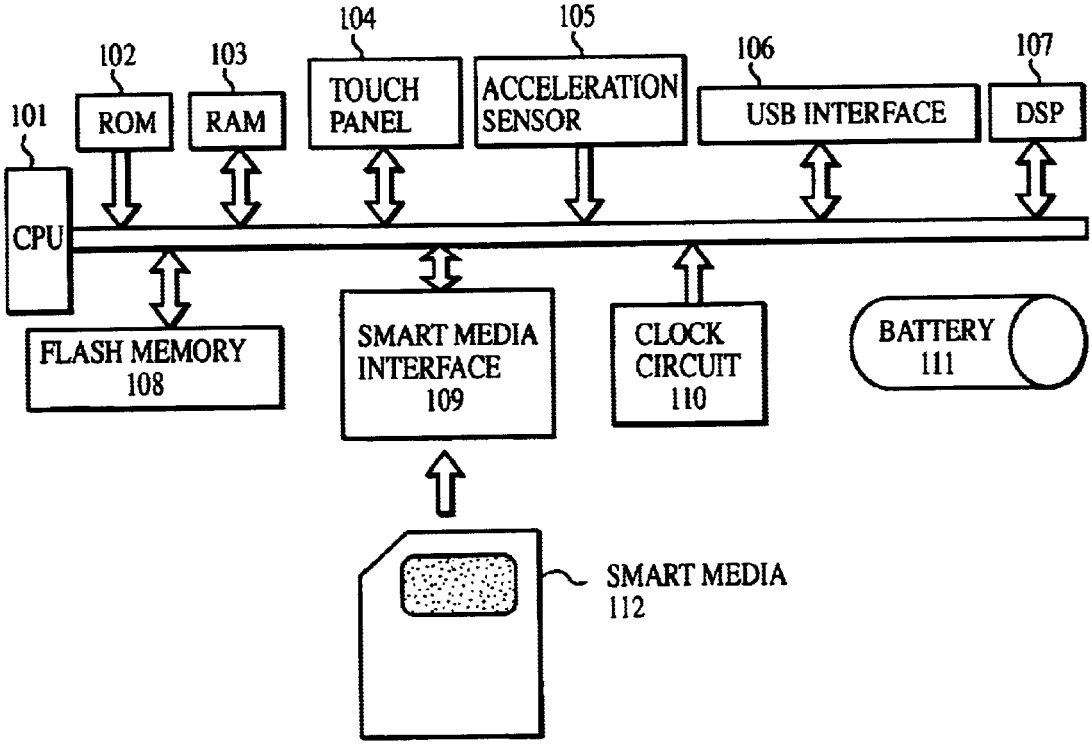

FIG. 8 illustrates a sample of an actual hardware configuration according to the first preferred embodiment of this invention. In this configuration, an exerciser does not use a conventional chest belt, nor wrist-watch type device, but he will use fitness headphones as shown in FIG. 8(*a*). The unique point in this configuration comparing with a conventional headphones is external auditory canal portion 210. Light emitter 211 of the external auditory canal portion has emitter diode 211-1, and emitter interface circuit 211-2 for the interface. Photodetector 212 of the external auditory canal portion has photo transistor 212-1, and detector interface circuit 212-2. This fitness headphones 200 have a pair of conventional right and left phones 214-1A, 214-1B for listening the stored rhythms. Fitness headphones 200 are connected with fitness controller by USB cable 300.

Fitness controller 100 can be installed either separately from the fitness headphones or within the fitness headphones as shown in FIG. 8(*b*). The controller comprises ROM 102 which stores the operational program, RAM 103 for storing the necessary data, touch panel 104 for inputting the various exercise data of the exerciser and displaying the data, acceleration sensor 105 which detects the exercise motion of the exerciser, USB interface 106 for interfacing with fitness headphones 200, DSP 107, flash memory 108, interface circuit 109 for smart media 112 which stores data tables for music, music data, and AT calculation program, and clock circuit 110. All of these units are connected with bus line 113 with CPU 101. Battery 111 is used as a power source.

1) How the External Auditory Canal Portion is Positioned

The signal detected by the pulse wave sensor, which consists of a light emitter 211 and photodetector 212 on the surface of the external auditory canal portion, is transmitted from the headphones 200 to the fitness controller 100, which processes it to detect the pulse wave and calculates the amplitude of that pulse wave. An audio signal proportional to the calculated amplitude of the pulse wave is transmitted from the fitness controller to the headphones, and the user turns the adjustment knob 220 on the external auditory canal portion 210 while listening to the sound. He can thus orient the external auditory canal portion so that amplitude of the pulse wave is maximized. When the audio output function of the headphones is being used to position the external auditory canal portion, the system is controlled so that no other signal is transmitted from the controller to the headphones. By turning the control knob while listening to the audio signal, the user can find the most appropriate orientation for the external auditory canal portion. Once he has found that orientation, the fitness controller transmits a signal to the external auditory canal portion telling it to expand. The expanding portion 213 expands to fit snugly into the external auditory canal so that it will be able to detect the pulse wave clearly. When the fitness controller has finished sending the "expand" signal to the headphones, it stops sending the audio signal to orient the external auditory canal portion. However, there may be times when it is not necessary to expand the adjustable layer of the expanding portion to correctly position the external auditory canal portion. If the user's earlobe is shaped so that the part that fastens to it fits exactly, the spring force of the headband may hold the external auditory canal portion securely against his ear. In this case, the external auditory canal portion can be positioned correctly in the external auditory canal without expanding the adjustable layer, and the "expand" signal need not be transmitted from the fitness controller to the headphones.

2) Calculating the AT Value (Anaerobic Threshold Value)

An audio signal instructing the user to exercise is sent from the fitness controller to the headphones, and the user exercises. In order to be able to calculate the AT value, audio data is transmitted telling the user to incrementally increase the intensity of his exercise. However, if the instructions which tell the user to increase the intensity of his exercise so that the AT value can be calculated are too boring, couch potatoes will not follow them. These instructions have to be interesting. If the workout is combined with music or a video, so that the person can listen to good music or watch a video while he exercises, he will exercise longer and be able to work out at a fixed rhythm and intensity for a given period. Even if he is exercising to the same music and for the same length of time, the intensity can still be varied. For example, the can be told to double the number of exercises using the same rhythm. Let's say he is listening to music with the beat "da-da-DAH-da-da-da" and kicking every time there is a stressed beat. If he is kicking low, the exercise is low-intensity. If he switches to high kicks, he increases the intensity of his exercise. If he is jumping on every stressed beat, he can increase the intensity by squatting on the first two unstressed beats and jumping on the stressed beat. If the headphones provide fitness music like that shown in FIG. 2 as well as appropriate instructions, the person can be directed to exercise at various intensities.

In order to calculate the AT value, a play list is used which features fitness music that allows the intensity to be incremented slightly every two minutes. An example of such a play list is shown in FIG. 3. In the music data table shown in FIG. 2, which is provided in fitness controller, only a limited amount of music is stored. It is, however, possible to store more music which has different intensities. If the vendor of the fitness controller can select the music to be stored, it will be more flexible to select music which has some certain data format, and intensity indexes. These music data can be obtained via their Website. The exerciser can access the Website by his computer which is not shown here, and he can input the data, such as age, sex, his heart rate during rest time according to the question format in the Website, then he may be able to download only proper music which fits to his intensity level. As an alternative, he may able to select only his favorite music. The music data table shown in FIG. 2, and the corresponding audio data can be stored in the smart card, and the card data can be read by the fitness controller.

Figure 5:
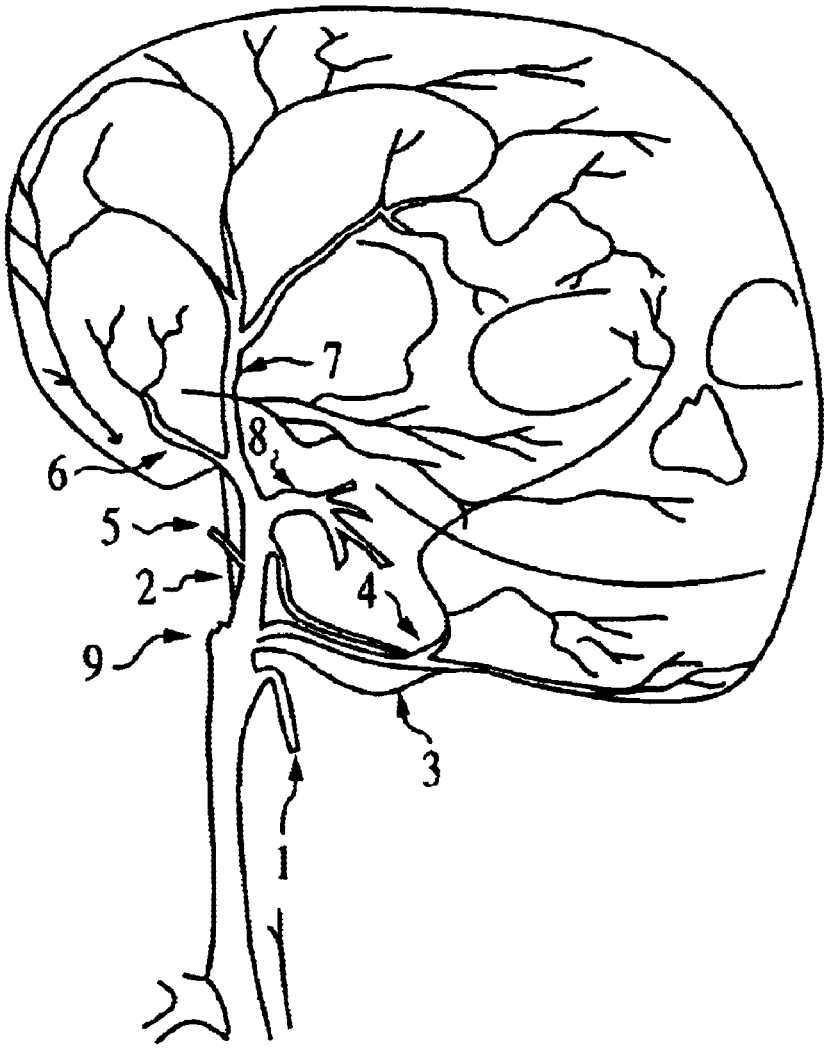
FIG. 5 illustrates the location of the superficial temporal artery in the person's head.
Figure 6:
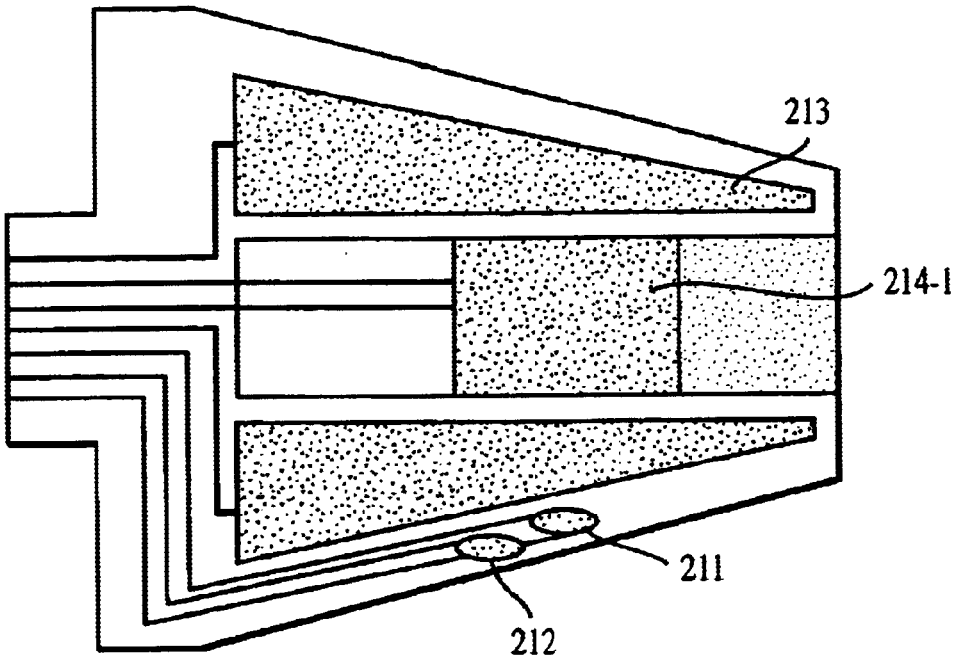
FIG. 6 illustrates the external auditory canal piece according to the first preferred embodiment of this invention.
Figure 7:
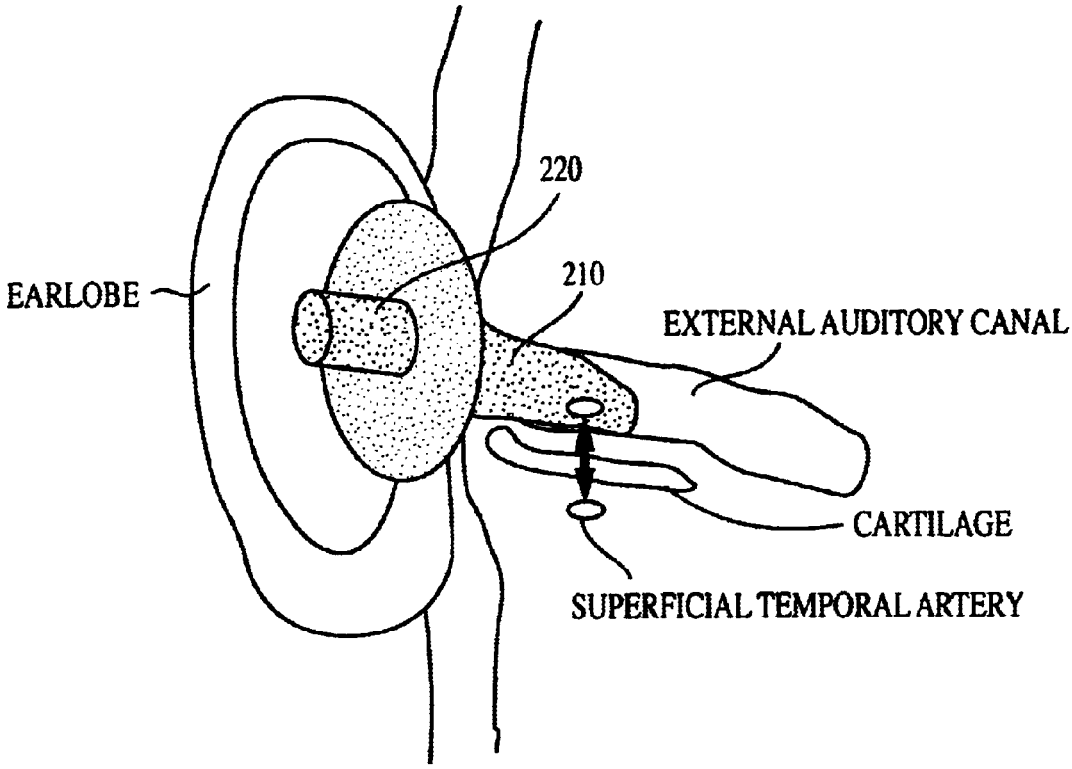
FIG. 7 illustrates how to detect the superficial temporal artery.

The fitness controller 100 sends audio data to the headphones 200 which go along with the fitness music program shown in FIG. 3. The actual sentences recorded as instructions are converted to audio using a voice synthesizer function and is sent by the controller to the headphones. In the example in FIG. 3, the sentence data for "It's time to start your workout" are read out, converted to voice and transmitted to the headphones. Next, the audio data for tune number 1 are read out of the music data table in FIG. 2. The tune is repeated the number of times indicated in Table 3 and sent to the headphones as audio data. This is done for all the tunes listed in FIG. 5 in order from the top down. As the fitness controller executes this routine, the person wearing the headphones gradually increases the intensity of his workout. Exercising to bouncy music prevents him from feeling burdened. By changing the music, detecting the pulse wave signal while repeatedly increasing the difficulty of the workout about every two minutes, and analyzing the data, we can obtain the AT value.

Figure 4:
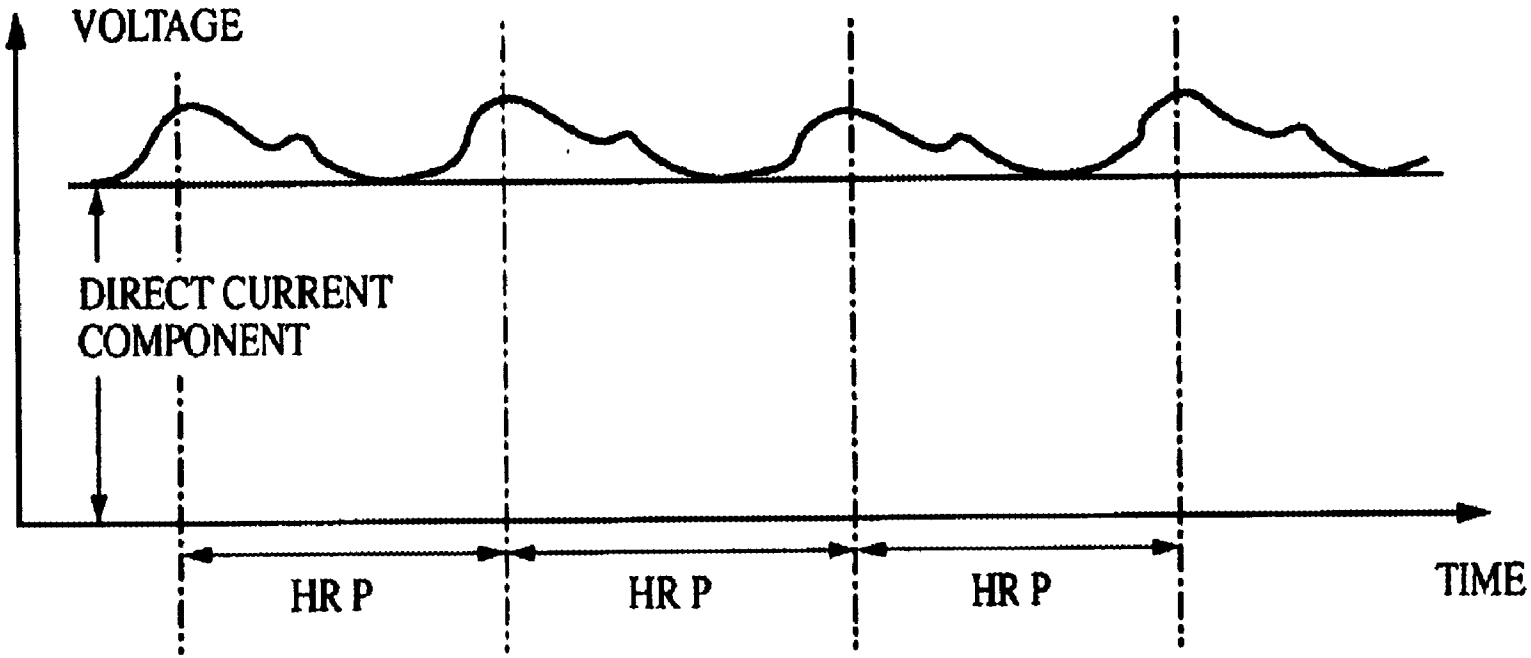
FIG. 4 illustrates the graph showing the fluctuation of the cardiac cycle length in the first preferred embodiment of this invention.

The wave form of the pulse wave obtained by the light emitter 211 and photodetector 212 in the external auditory canal portion 210 in the form of the light reflected off the superficial temporal artery is shown in FIG. 4. The detection signal sent from the external auditory canal portion to the fitness controller is A/D converted, and its voltage value at every sampling time is stored in the fitness controller's memory. A CPU in the fitness controller uses software to analyze the wave form of this pulse wave and calculates the cardiac cycle length for every pulse. In FIG. 4, HR1, HR2 and HR3 are cardiac cycle lengths.

HRP(i) would be the "i"th cardiac cycle length. The following processing is used to detect the fluctuation of the cardiac cycle length for HRP(i). If we call the variation of the cardiac cycle PI(i), we can calculate the fluctuation by the following formula.

$$PI(i)=\{HRP(i)-HRP(i+1)\}\times 100/HRP(i)$$

The variation of the pulse for the pulse waves obtained from two minutes' worth of pulse wave signals is calculated in 1% gradients, and the frequency distribution is generated. In other words, PI(k) to PI(k+N−1) represents two minutes' worth of variation data. This being the case, N number of variation data are apportioned into 100 spaces representing less than 1%; more than it but less than 2%; more than 2% but less than 3%; - - - ; and more than 99% but less than 100%. The number of variation data PI in the space for more than (x−1)% but less than x % we shall call g(x). The function obtained by dividing g(x) by the number N of variation data is p(x)=g(x)/N. Thus the entropy H of the fluctuation of the cardiac cycle length can be calculated by the following formula.

$$H = -\sum_{i=1}^{100} P(i) \times \log_2 P(i)$$

From the data for HRP(K) through HRP(k+N−1), we obtain the entropy H(k) using the method given above. Moving from space to space for the N data of cardiac cycle length HR(i), we obtain the entropy H for each. That is, while changing k, we obtain the average value of the N cardiac cycle lengths HR(i) for HRP(k) through HRP(K+N−1), and we create a table in which this value corresponds to the entropy H obtained from the N cardiac cycle lengths i.e., a table of the correspondence between average cardiac cycle length and entropy). The number of the tune which takes up the most time in the time space is also recorded in the cardiac cycle length and entropy table. If we express the cardiac cycle lengths in units of one second, the heart rate will be 60/cardiac cycle lengths. The table could also be filled in so as to show the correspondence between heart rate and entropy. From the chart, we obtain the heart rate or cardiac cycle length at the time the entropy is at its minimum value. This is the AT value. If we record the exercise intensity at the time the AT value is generated, we can obtain an AT value which is expressed as intensity of exercise.

3) Calculating the Optimal Intensity and Duration for the Workout

The value obtained by multiplying the heart rate at the time the entropy reaches its minimum value (the AT point) by 80% is considered to be the optimal heart rate for aerobic exercise. Let us assume a duration of 30 minutes, and let us call the period taken up with exercise performed to calculate the AT value T0. The value obtained by subtracting T0 from 30 minutes, which we shall call T1, is the required duration of the workout. The optimal intensity is defined by the exercise intensity which results to 80% of heart rate at the heart rate of AT point, but the optimal intensity is actually set by a certain heart rate zone, such as 70%–90% of the heart rate at AT point. This zone can be called as a target zone. During the exercise, the controller can monitor the target zone, and send a warning voice guidance or display guidance if his heart rate goes out of this zone.

4) Choosing the Appropriate Tune

When the optimal heart rate has been determined by the processing outlined above, the tune which corresponds to the optimal heart rate is found in the music data table. Since the number of the tune for each heart rate is recorded in the table of correspondences, the number with the heart rate closest to the optimal rate can be read out. The audio data for the tune are read out and the tune is played repeatedly throughout the workout period T1.

5) Playing a Tune for Cooling Down

When the person has finished working out at his optimal heart rate, he should not abruptly stop exercising but rather should gradually wind down. A tune is played for him to help him cool down. The audio data for tune number 2 in the music data table are sent to the headphones.

6) Uploading Cumulative Exercise Data Stored in the Fitness Controller

The fitness controller is connected to a personal computer. The data in the fitness controller is transmitted to the computer at the exercise aid service company.

7) Calculation for Fat Combustion Rate from Heart Rate

Fat combustion rate can be obtained based on the calculated AT value, monitored heart rate, and the accumulated duration for each heart rate using the algorithm disclosed in document 2. The actually calculated fat combustion rate (g) can be displayed on the display of the fitness controller, and this gives the exerciser a great incentive who wishes to be slimmer. When the exerciser starts the exercise, he can touch the start button on the touch panel of the fitness controller, and touch the end button at the end of the exercise. This simple operation can calculate the fat combustion rate of the day. In addition to this calculation, it is also possible to accumulate the daily fat combustion rate to obtain the weekly fat combustion rate.

Second Preferred Embodiment

We shall next explain an exercise aid device which uses ultrasound to detect the pulse wave by measuring the velocity of the blood flow in the superficial temporal artery. This type of device uses both VR glasses and headphones. VR glasses are currently available on the market.

Source: http://www.cwonline.com/cyvisor.asp

Figure 9:
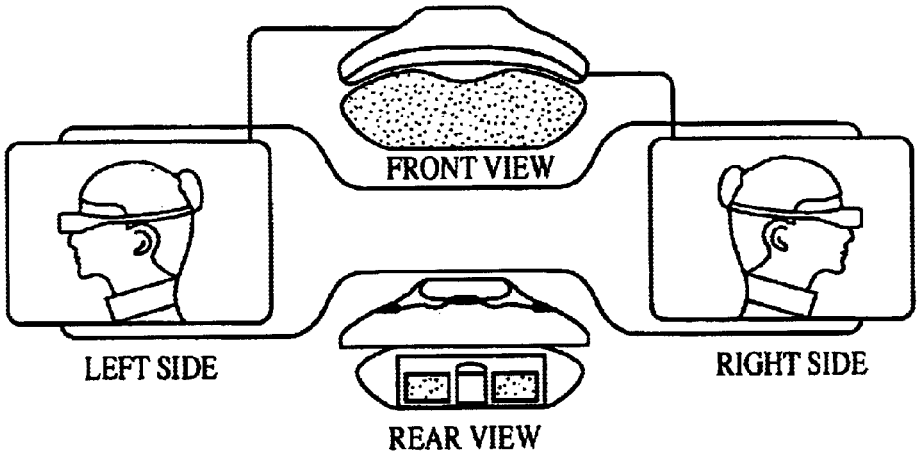
FIG. 9 illustrate a sample of VR glasses.

FIG. 9 shows a actual sample of VR glasses.

The second embodiment has the following characteristics.

1. The pulse wave can be detected very accurately by measuring the blood flow with ultrasound.
2. For ultrasound measurement, the sensor is not inserted into the external auditory canal, but attached as a sensor pad behind the right ear.
3. VR glasses (VR goggles) allow the user not only to listen to music while he exercises but also to watch video imagery. (Example: The virtual world could be a marathon in which the user runs along streets of his own choosing.)
4. It is not necessary to increase the level of exercise gradually in order to be able to calculate the AT value. The user can exercise as he wishes, and the AT value can be calculated using the data obtained in this way.

Figure 10:
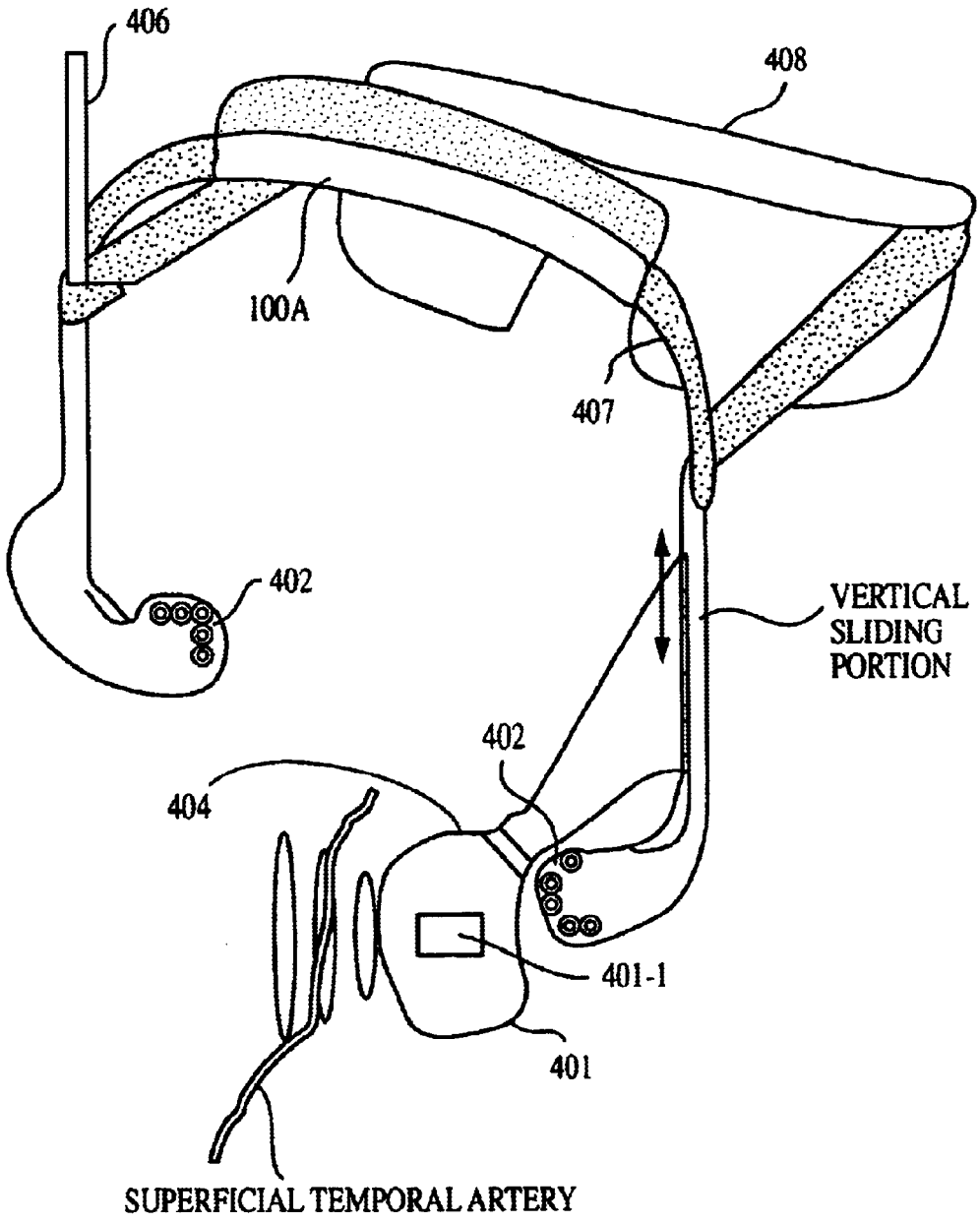
FIG. 10 illustrates the overview of the fitness headphones according to the second preferred embodiment of this invention.

As shown in FIG. 10, fitness headphones 400 according to the second preferred embodiment is configured as one unit type which is a combination with fitness controller 100A for reducing the size. Unlike the first preferred embodiment to use the optical device for detecting the heat, the second preferred embodiment uses ultrasonic blood velocity meter 401-1 provided in probe 401 of a blood velocity meter to detect the blood flow velocity. The probe 401 of ultrasonic blood velocity meter has a flexible portion 404 to adjust the contacting vertical angle to the superficial temporal artery which is behind the exerciser's ear. This flexible portion also pushes the probe 401 to the head by itself. Fitness headphones 400 has a vertical sliding portion 405 to adjust the probe in vertical direction, and head band 407. It also has VR glasses 408 for giving an motivation to the exerciser visually. The fitness headphones has antenna 406 to communicate with a control glove to control the image in VR glasses as will be mentioned. For adjusting the position of the ultrasonic blood velocity meter, one of the indications will be to make a louder sound, higher frequency sound, or shorter pulse sound if the probe is positioned correctly to the right spot during the exerciser is adjusting the probe 401 in vertical direction or changing the angle of the probe. The exerciser can, thus, adjust the probe 401 in the vertical direction or change the angle for locating the best spot for the blood velocity meter.

To make the position of the device on the person's head more stable, the components may be built into a helmet. A wave of ultrasound is emitted by a probe into the superficial temporal artery. This ultrasonic wave, which has a given frequency (in MHz), strikes the blood flow. The waves reflected by the red cells and white cells are then detected. The Doppler effect, which states that the frequency is proportional to the velocity of the flow (in this case, the velocity of the corpuscles), is used to convert the frequencies of the reflected waves into the blood velocity. The velocity of the blood varies with the heart rate.

Figure 11:
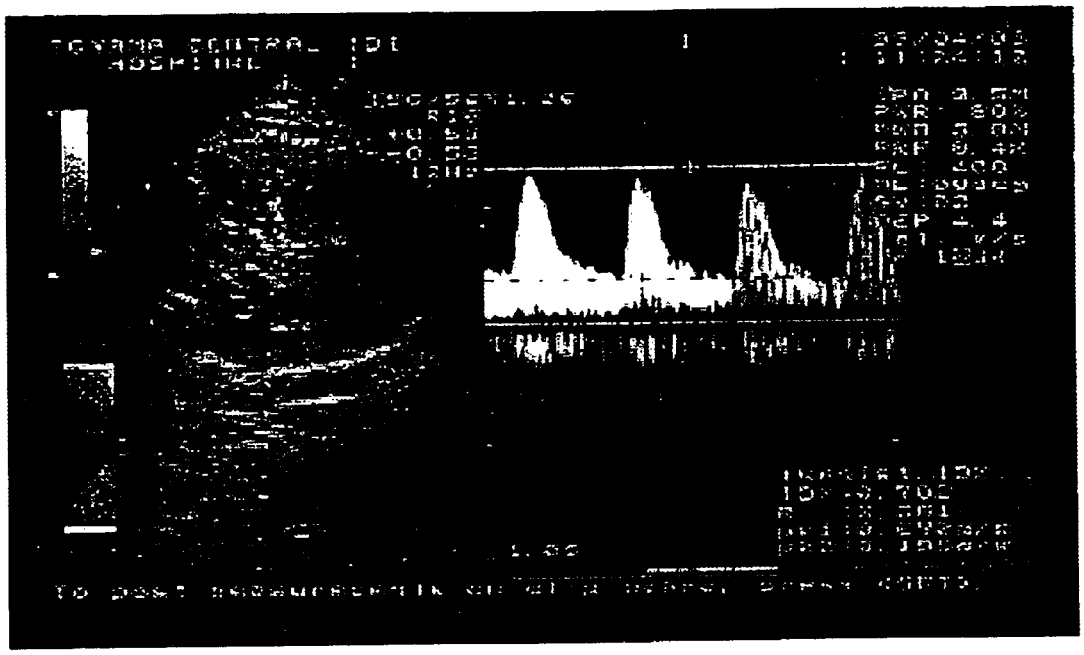
FIG. 11 illustrates a sample of graph showing the wave form of the blood flow velocity according to the second preferred embodiment of this invention.

In FIG. 11, we have provided an example of the monitored wave form of the velocity of the blood flow in the artery. (The ultrasound method does not measure the flow in the superficial temporal artery but of various arteries in the head.)

Source: http://sun1.tch.pref.toyama.jp/mcmc/fetal_administration.html

By processing the wave form of the blood flow velocity shown in FIG. 11, we can calculate the pulse rate. Just as in the first embodiment, the fitness controller transmits to the headphones audio data instructing the user to exercise. The detection signal transmitted to the fitness controller is A/D converted, and the voltage value at each sampling time is recorded in the fitness controller's memory. Thus the wave form of the blood velocity which shows the pulse wave is recorded. The CPU in the fitness controller analyzes this pulse wave using software for that purpose and calculates the cardiac cycle length for each pulse of the wave. HRP(i) is the "i"th cardiac cycle length.

(1) Calculating the AT Value

The user himself selects a suitable tune from the list shown in FIG. 2 and begins to exercise. He should not begin his session abruptly, but should warm up first. He should be advised to exercise to music for ten minutes to warm up before beginning his routine. If he chooses exercise of too low an intensity, the fitness controller can instruct him to pick up the pace a little and, for example, begin to play tune number 7. Basically, however, the intensity of the exercise is not controlled so that it increases gradually. The user gets to choose what sorts of exercise he wishes to do. All the while he is exercising, his pulse is detected based on the blood velocity signal obtained by the ultrasound probe in the headphones. From these data the cardiac cycle length is calculated for each pulse and stored in the fitness controller's memory. Let us call the cardiac cycle length of the "i"th pulse wave HRP(i). Since the intensity of the exercise is not being controlled to increase over time, HRP(i) will vary over time. The cardiac cycle length expressed in units of one second can be converted into heart rate per minute. If we call the heart rate of the "i"th pulse wave HRN(i), it can be defined by the following formula.

$$HRN(i)=60/HRP(i)$$

The fluctuation of the cardiac cycle length for HRP(i) can be detected through the following processing. Let us call the variation of the cardiac cycle length PI(i). It can be calculated by the following formula.

$$PI(i)=\{HRP(i)-HRP(i+1)\}\times 100/HRP(i)$$

The variation of the pulse in the pulse wave obtained from two minutes' worth of pulse wave signals is aggregated in 1% gradients, and the frequency distribution is generated. Let us say that PI(k) to PI(k+N−1) represents two minutes' worth of variation data. This being the case, N number of variation data are apportioned into 100 spaces representing less than 1%; more than 1% but less than 2%; more than 2% but less than 3%; - - - ; and more than 99% but less than 100%. The number of variation data PI in the space for more than (x−1)% but less than x % we shall call g(x). The function obtained by dividing g(x) by the number N of variation data is p(x)=g(x)/N. Thus the entropy H of the fluctuation of the cardiac cycle length can be calculated by the following formula.

$$H=-\sum_{i=1}^{100} P(i)\times\log_2 P(i)$$

From the data for HRP(k) through HRP(k+N−1), we obtain the entropy H(k) using the method given above. Moving from space to space for the N data of cardiac cycle length HR(i), we obtain the entropy H(k) for each. That is, while changing k, we obtain the average value of the N cardiac cycle lengths HRP(i) for HRP(k) through HRP(k+N−1), and from this we obtain the heart rate HRN(k). we create a table in which this value corresponds to the entropy H(k) obtained from the N cardiac cycle lengths (i.e., a table of the correspondence between average heart rate and entropy). We then arrange the data in this table in order by heart rate.

We plot the data in the table on a graph, with entropy on the vertical axis and heart rate on the horizontal. In other words, we plot (HRN(k), H(k)) to obtain the graph shown in FIG. 12. Let us assume that k=1 through N.

Figure 12:
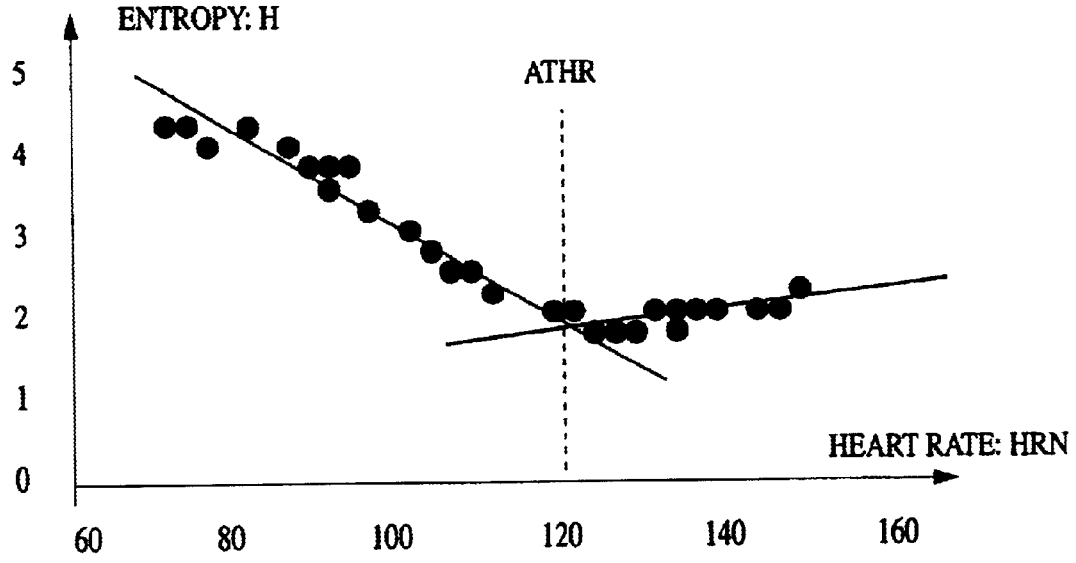
FIG. 12 illustrates the relationship between entropy and heart rate.

As shown in FIG. 12, taking heart rate HRNm as the border, we can divide the graph into two discrete regions, one in which the data fall in the range less than HRNm (the left side) and one in which they fall in the range greater than HRNm (the right side).

We apply the least squares method to the line with a negative slope on the left side of the graph, and we obtain the average value of the distance that each data point is from the line. we apply the least squares method to the line with a positive slope on the right side of the graph, and we obtain the average value of the distance each data point is from that line. We obtain the aggregate value of the average distance from the line on the left and right sides and we consider this the evaluation function for the border point we called HRNm. We obtain the value of the evaluative function as we vary the value of HRNM. We take the value of HRNm at the point in time when this function has its minimum value as the ATHR (i.e., the heart rate at the AT point).

When we calculate the AT value using this method, we eliminate the need for any special hardware (such as a mechanism to vary the load on the pedals of a stationary bike) to gradually increase the intensity of the exercise. We are able to calculate the AT value without using special exercise devices.

(2) How to Realize an Enjoyable Virtual Marathon Course

Once we have calculated the AT value, we find the number of the tune which caused the user to exercise so that his heart rate was at 80% of the AT level. He could then, to give one example, run on a treadmill at the optimal intensity while listening to that music on his headphones. By displaying images from a DVD player on the VR goggles, we can give the user the comfortable experience, including video and audio.

Figure 13:
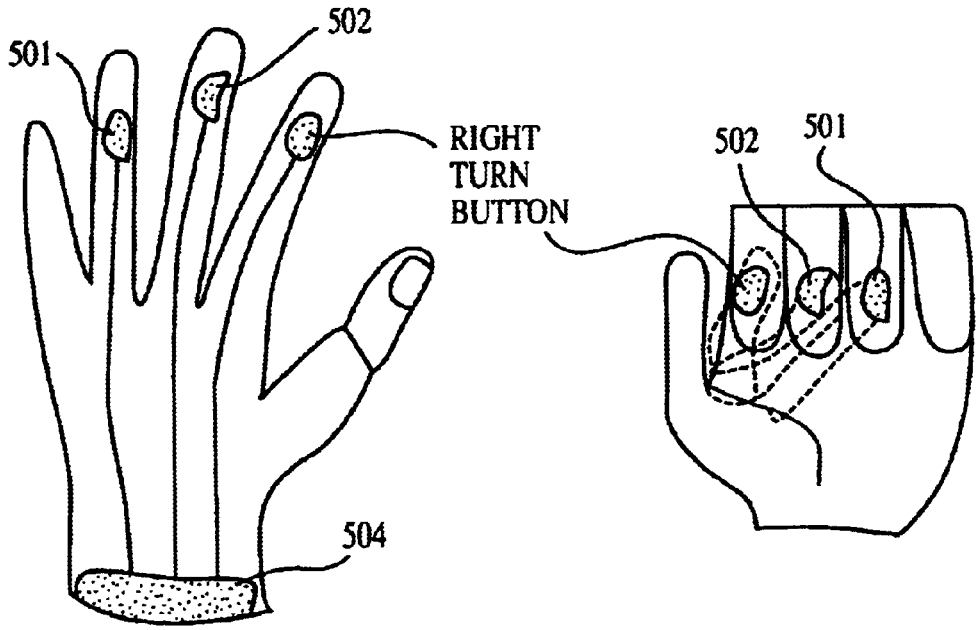
FIG. 13 illustrates the overview of the control glove for VR glasses.

Running a virtual race requires operating buttons to turn right or left at points where the virtual course branches and to stop. When the user is running on a treadmill or gripping the handlebars of a stationary bike for indoor exercise, this kind of control can be provided easily in the form of a control glove as shown in FIG. 13. There are three buttons on the surface of the control glove. When the user pushes these buttons, data are transmitted remotely to the fitness controller.

Figure 14A:
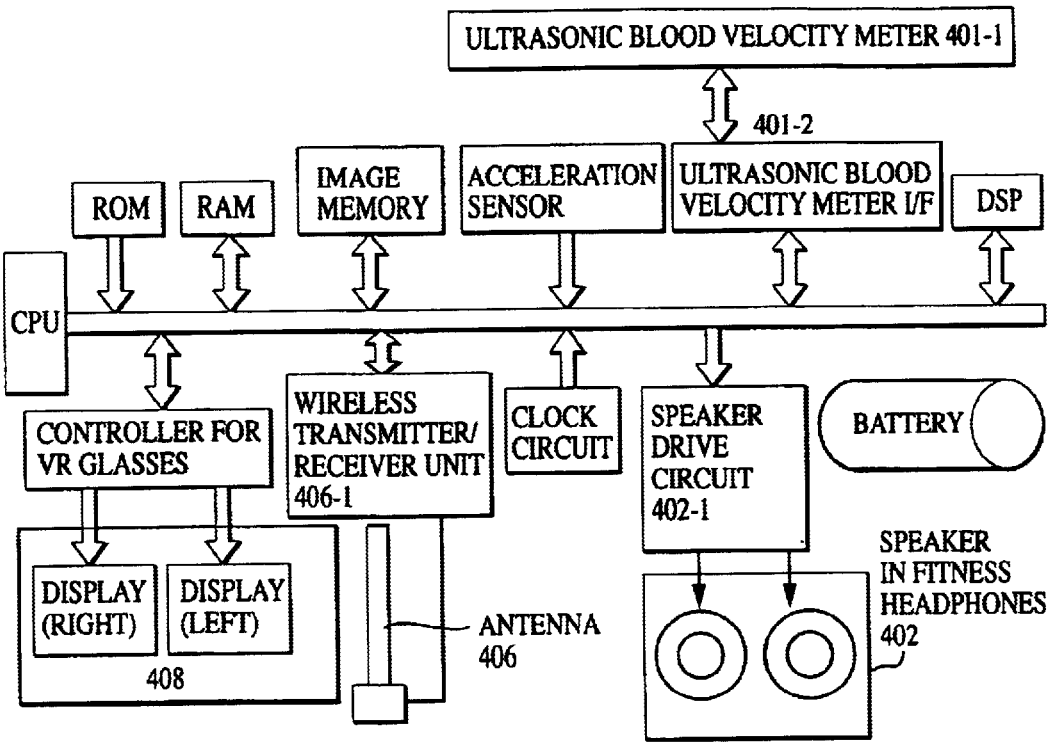
FIG. 14 illustrates the hardware configuration of the second preferred embodiment.
Figure 14B:
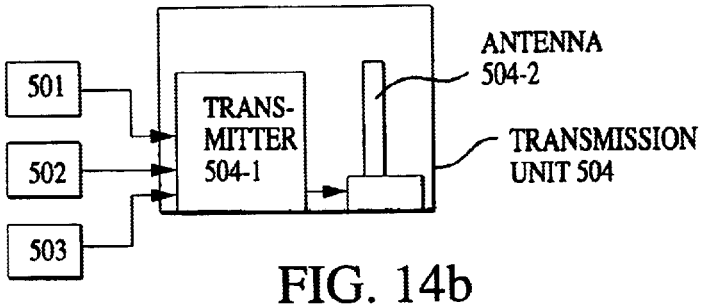
Figure 14C:
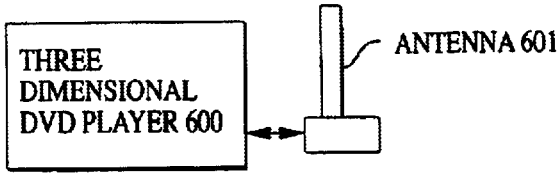

FIG. 14 illustrates the hardware configuration of the second preferred embodiment. Unlike the first preferred embodiment, the fitness headphones have ultrasonic blood velocity meter 401-1 comprising the ultrasonic emitter/receiver unit shown in FIG. 107 and interface circuit 401-2 for it. It has display units for right and left eyes of VR glasses 408, video controller 408-1, right and left speakers 402 and the drive circuit 402-1 for them, and wireless transmitter/receiver unit 406-1 and antenna 406.

As explained above, control glove 500 for controlling the VR glasses is provided with transmission unit 504 to transmit the signals of control buttons 501-503 to antenna 406 of fitness headphones 400. As shown in FIG. 14(*c*), three dimensional DVD player also has antenna 601 for transmitting the image to the fitness headphones.

Figure 15:
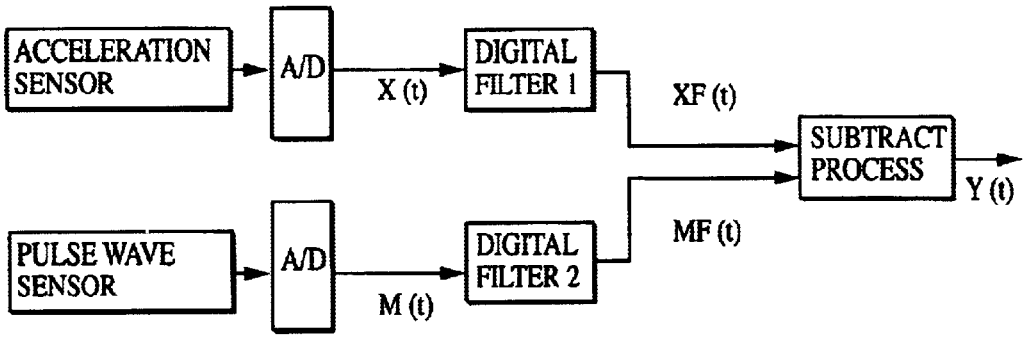
FIG. 15 illustrates how to remove disturbance due to physical movement during exercise from the wave form signal of the pulse wave in order to detect the pulse.

Material 1: How to remove disturbance due to physical movement during exercise from the wave form signal of the pulse wave in order to detect the pulse. FIG. 15 illustrates a configuration to remove disturbance from the wave form signal of the pulse wave.

The pulse wave detected at the artery is affected by both the heart rate and the movement of the body. The movement of the user's body can be detected using signals output by an acceleration sensor in the fitness controller. However, the acceleration represented by this signal does not, in its untreated form, give us the wave form of the pulse wave. The characteristics of the circulatory system (i.e., the transfer function) will create a time lag or corrupt or attenuate the wave form, and this effect will be demonstrated in the blood vessels which the pulse wave sensor is monitoring. This time lag or corruption or attenuation of the wave form can be expressed using a filter. If the characteristic parameters of the filter are obtained experimentally, the data can be processed to remove the effect of the physical movement. The time lag, corruption, or attenuation of the wave form can be expressed by converting the signal from analog to digital and subjecting it to a digital filter. Once digitized, the wave form on the temporal axis can be processed as X(t) and M(t). These data, which are obtained by sampling at intervals t, are stored in the memory. The wave form from which the effects of physical movement have been removed, which we call Y(t), is obtained by the following formula. A, B, C and D are the coefficient array of the digital filter. This coefficient array can be optimized by using the most appropriate algorithm for the digital filter.

$$XF(t) = \sum_{i=0}^{M} A(i)X(t-i) - \sum_{j=0}^{N} B(j)XF(t-j)$$

$$MF(t) = \sum_{i=0}^{M} C(i)F(t-i) - \sum_{j=0}^{N} D(j)MF(t-j)$$

$$Y(t) = MF(t) - XF(t)$$

Document 2: Algorithm to calculate fat combustion rate from heart rate.

1. The fat combustion rate is expressed by the following formula. (Combusting 1 g of fat expends 9 Kcal.)

Fat combustion rate (g/min)=calories expended (kcal/min)×fat combustion ratio (%)÷9 Formula 1.

2. The fat combustion ratio is 50% for a level of exercise below the AT point, and it decreases steadily once the person has crossed the AT point. It is calculated to be 0% at the maximum load.

3. The number of calories expended during exercise can be calculated by the following formula, according to the discussion in Japanese Patent Publication 8-52119.

(1) For men:

Calories expended (kcal/min)=*B*1×(pulse rate at time measured (pulses/min)−renting pulse rate while standing (pulses/min)+*C*+0.3645 Formula 2.

Here B1 is a coefficient with the following value.

*B*1=0.0109×(LBM/Ht/Ht)−0.0023×(% fat)−0.0007×(age) −0.0211 Formula 1.

LBM=(weight−bodyfat ratio×weight)

Ht=height (m)

% fat; bodyfat ratio expressed as a percentage

Here C is the basic metabolic rate (value for 1 minute). It is calculated from the person's age, sex, height and weight.

(2) For women:

Calories expended (kcal/min)=*B*1×(pulse rate at time measured (pulses/min)−resting pulse rate while standing (pulses/min)+*C*+0.1812 Formula 4

Here B2 is a coefficient which has the following value.

*B*2=0.0140×(LBM/Ht/Ht)−0.0012×(% fat)−0.0007×(age)−0.0211

LBM=(weight−bodyfat ratio×weight)

Ht=height (m)

% fat: bodyfat ratio expressed as a percentage

Here C is the basic metabolic rate (value for 1 minute). It is calculated from the person's age, sex, height and weight.

4. Calculating the heart rate under maximum load (maximum heart rate)

The maximum heart rate can easily be calculated by the following formula.

Cumming's formula: Maximum heart rate
*HMAX*=210−0.788×age Formula 5

5. Calculating rate of fat combustion per heart rate (1) Let us call the heart rate at the AT point S. The rate of fat combustion at a heart rate H which exceeds S can be calculated by the following formula.

Rate of fat combustion (%)=50−(*H*−*S*)×50/(*HMAX*−*S*) Formula 6

(2) The rate of fat combustion for a heart rate below the AT point is normally calculated to be 50%.

6. Calculating the quantity of fat combusted

The duration of exercise at each heart rate is recorded in minutes. The number of calories burned per minute at a given heart rate is calculated using the formulas given above. The quantity of fat combusted is also calculated. The quantity of fat combusted by exercise at that heart rate is; number of calories expended by exercise at that heart rate×rate of fat combustion×duration of exercise (in minutes). This calculation is performed for each heart rate, and the quantities of fat combusted at the various heart rates are added together to obtain a total quantity of fat consumed.

What is claimed is:

1. An exercise aid device, comprising:

a fitness headphone comprising a headphone and a sensor unit, said sensor unit provided in said fitness headphone, said sensor unit operable to monitor an artery near an ear of an exerciser and to detect artery signals corresponding to a movement of said artery; and a fitness controller to control audio sound which said exerciser can hear, said audio sound being controlled in response to the detected artery signals.

2. An exercise aid device, comprising:

a fitness headphone comprising a headphone and a sensor unit, said sensor unit provided in said fitness headphone, said sensor unit operable to monitor an artery near an ear of an exerciser and to detect artery signals corresponding to a movement of said artery;

a sensor position adjustment mechanism to adjust the position of said sensor unit; and a fitness controller to control audio sound which said exerciser can hear, said audio sound being controlled in response to the detected artery signals.

3. An exercise aid device according to claim 1, wherein said artery signals corresponding to said movement of said artery are characterized as a pulse wave, and said fitness controller controls said audio sound based on a measured value obtained from said detected pulse wave.

4. An exercise aid device according to claim 1, wherein said artery signals corresponding to said movement of said artery are characterized as a blood velocity wave, and said fitness controller controls said audio sound based on a measured value obtained from said detected blood velocity wave.

5. An exercise aid device according to claim 1, wherein said fitness controller determines an optimal exercise intensity based on an anaerobic threshold value which is derived from said detected artery signals, and wherein said fitness controller transmits said appropriate exercise intensity level by said audio sound to said fitness headphone.

6. An exercise aid device according to claim 5, wherein said optimal exercise intensity results in maximum fat combustion physiologically.

7. An exercise aid device according to claim 5, wherein said sensor unit is provided in an external auditory canal portion, and said sensor unit comprises:

a light emitter to emit a light beam to a superficial temporal artery of said exerciser; and a photodetector having an optical element which receives a reflected light reflected on said superficial temporal artery in an external auditory canal, said reflected light being affected by expansion and contraction of said superficial temporal artery, wherein said photodetector is able to detect said artery signals.

8. An exercise aid device according to claim 7, wherein said external auditory canal portion is provided with an adjustment mechanism to adjust a position of said light emitter and said photodetector.

9. An exercise aid device according to claim 5, wherein said sensor unit is provided in an ultrasonic blood velocity probe, and said sensor unit receives a reflection of ultrasonic sound emitted to a superficial temporal artery positioned behind said ear of said exerciser to detect a blood velocity, thereby said sensor unit is able to detect said artery signals based on said blood velocity.

10. An exercise aid device according to claim 9, wherein said ultrasonic blood velocity probe can be adjusted by an adjustment structure to contact said superficial temporal artery positioned behind said ear of said exerciser.

11. An exercise aid device according to claim 5, wherein said anaerobic threshold value is obtained by a heart rate at a time an entropy is at minimum value, said entropy being obtained by a fluctuation of the cardiac cycle length.

12. An exercise aid device according to claim 11, wherein said fitness controller sends a plurality of previously stored different audio rhythms through said fitness headphone, said plurality of different audio rhythms cause a change in exercise intensity as time goes by, said exerciser makes a motion with said different audio rhythms to vary said heart rate, and then said anaerobic threshold value is obtained by said heart rate at said time said entropy is at minimum value.

13. An exercise aid device according to claim 11, wherein said anaerobic threshold value is obtained by a heart rate at a time an entropy is at minimum value, said entropy being obtained by a random fluctuation of the cardiac cycle length caused by random movements of said exerciser.

14. An exercise aid device according to claim 12, wherein an audio rhythm of said optimal exercise intensity is selected from said plurality of different audio rhythms and matches said exercise intensity of said anaerobic threshold value.

15. An exercise aid device according to claim 13, wherein an audio rhythm of said optimal exercise intensity is selected from said plurality of different audio rhythms and matches said exercise intensity of said anaerobic threshold value.

16. An exercise aid device according to claim 5, wherein said fitness headphone further comprises a display unit to display a fat combustion rate.

17. An exercise aid device according to claim 5, wherein said fitness headphone further comprises an external memory unit to store said plurality of audio rhythms, exercise data, and a program for calculating said anaerobic threshold value.

18. An exercise aid device according to claim 5, wherein said fitness headphone further comprises virtual reality glasses to aid said exerciser visually.

19. An exercise aid device according to claim 18, wherein said virtual reality glasses are provided with a virtual reality control glove, and wherein said exerciser can control an image produced by said virtual reality glasses by operating buttons which are provided at the ends of said exerciser's fingers, wherein said virtual reality control glove can communicate with said image produced by said virtual reality glasses wirelessly.

20. An exercise aid device according to claim 5, further comprising a disturbance removing means to remove disturbance due to physical movement during exercise from said artery signals output from said sensor unit and acceleration signals output from a built-in acceleration sensor.

21. An exercise aid device according to claim 2, wherein said sensor position adjusting mechanism comprises a rotary knob, or a vertical sliding portion and a flexible portion, and said adjusting mechanism can vary a signal sound for feeding back to said exerciser corresponding to said detected movement of said artery signals.

22. An exercise aid method to aid an exerciser to maintain an individual optimal exercise during an aerobic exercise, comprising the steps of:

calculating an anaerobic threshold value for said exerciser based on artery signals detected by a sensor unit provided in a fitness headphone;

determining an optimal exercise for said exerciser based on said anaerobic threshold value; and transmitting an audio rhythm through said fitness headphone which results in said optimal exercise for said exerciser.

23. An exercise aid device according to claim 20, wherein said disturbance removing means is operable for correcting a pulse rate measurement.

* * * * *